United States Patent [19]

Kertesz et al.

[11] Patent Number: 4,839,102

[45] Date of Patent: Jun. 13, 1989

[54] BLOCK FOR CONTAINING AND STORING RADIOACTIVE WASTE AND PROCESS FOR PRODUCING SUCH A BLOCK

[75] Inventors: Claude Kertesz, Puy Sainte Reparade; Gerard Koehly, Bievres; Frank Josso, Villeneuve Les Avignon; André Bernard, Chatillon, all of France

[73] Assignee: Commissariat a l'Energie Atomique, France

[21] Appl. No.: 126,855

[22] Filed: Nov. 30, 1987

[30] Foreign Application Priority Data

Dec. 5, 1986 [FR] France ..... 86 17081

[51] Int. Cl.[4] ..... G21F 9/16

[52] U.S. Cl. ..... 252/628; 106/90; 106/94; 106/102

[58] Field of Search ..... 252/628, 633; 106/85, 106/89, 90, 94, 97, 91, 102; 250/506.1

[56] References Cited

U.S. PATENT DOCUMENTS

| | | | |
|---|---|---|---|
| 4,119,560 | 10/1978 | Sheeline | 252/628 |
| 4,174,293 | 11/1979 | Colombo et al. | 264/0.5 |
| 4,222,889 | 9/1980 | Verpmann | 252/628 |
| 4,297,827 | 11/1981 | Allison | 53/282 |
| 4,483,789 | 11/1984 | Kunze et al. | 252/628 |
| 4,710,318 | 12/1987 | Horiuchi et al. | 252/628 |
| 4,762,646 | 8/1988 | Fougeron et al. | 252/628 |

FOREIGN PATENT DOCUMENTS

| | | | |
|---|---|---|---|
| 0006329 | 1/1980 | European Pat. Off. . | |
| 0124825 | 4/1984 | European Pat. Off. . | |
| 2717656 | 10/1978 | Fed. Rep. of Germany . | |
| 1246848 | 10/1960 | France . | |
| 938211 | 3/1961 | United Kingdom | 252/628 |
| 159683 | 8/1981 | United Kingdom | 252/628 |
| 2107917 | 5/1983 | United Kingdom | 252/628 |
| 2140194 | 11/1984 | United Kingdom . | |

*Primary Examiner*—Howard J. Locker

*Attorney, Agent, or Firm*—Kerkam, Stowell, Kondracki & Clarke

[57] ABSTRACT

The present invention relates to a block for containing and storing radioactive waste, as well as to a process for producing such a block. In known manner, the waste is coated in a composite matrix constituted by hardened cement and epoxy resin. According to the invention, the proportion of waste is between 35 and 45% by weight, the porportion of cement between 25 and 35% by weight and the proportion of resin between 20 and 40% by weight.

8 Claims, 1 Drawing Sheet

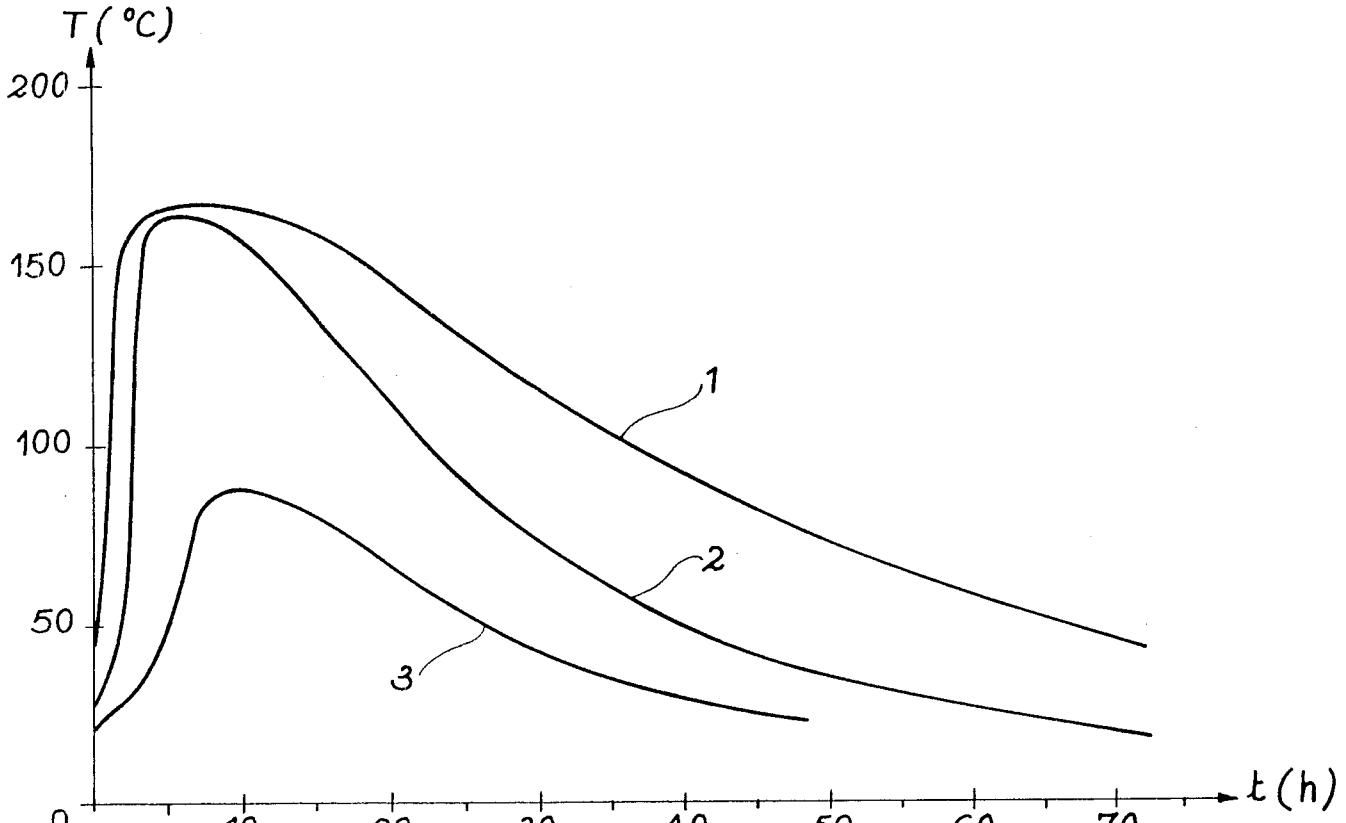
T (°C)
200
150
100
50
0
10
20
30
40
50
60
70
t (h)
1
2
3

BLOCK FOR CONTAINING AND STORING RADIOACTIVE WASTE AND PROCESS FOR PRODUCING SUCH A BLOCK

BACKGROUND OF THE INVENTION

The present invention relates to a block containing waste, as well as to a process for producing such a block, more particularly usable in the field of storing low and medium activity radioactive waste.

The waste from the nuclear industry can be of three different types. It can firstly consist of wet waste, such as the coprecipitation mud or sludge of liquid effluents, whose water content is approximately 20 to 40%. A second category is constituted by dry pulverulent waste e.g. formed by the incineration ash of combustible materials such as cellulose, polyvinyl chloride, rubber, neoprene, polyethylene, etc. The last category consists of so-called "technological waste", which covers the aforementioned waste types and incombustible waste, such as glass and metals.

At present, there are three main methods for coating low and medium activity radioactive waste with a view to their storage. These processes involve coating by a hydraulic binder (essentially cement), coating with bitumen and coating with polymers. Each of these methods is in principle applicable to a particular well defined type of waste and is not applicable to all the waste material types to be treated.

Treatment by cement is a method which is simple and inexpensive to carry out. However, the confinement quality is not very satisfactory when the coated product contains radioactive elements such as cesium or strontium. Industrial water leaching resistance tests have revealed that the leaching rate of such radioactive elements is high.

Coating by bitumen more particularly applies to waste materials like the sludges and concentrates of liquid effluents. This process makes it possible to obtain a stable product, but the mechanical behaviour of the coated products is not very satisfactory. Moreover, as a function of the radioisotope concentration, the product can be subject to radiolysis gas emissions, which may bring about a swelling of the coated product.

Coating in polymers consists of coating the waste in resins, e.g. thermosetting polyester resins or epoxides. The physical and mechanical properties of the product obtained, as well as the confinement are better than with coating methods in cement or bitumen. However, in certain cases, problems of compatibility between the resin matrix and the waste can be encountered, particularly in the case where it is wished to coat waste materials with a high water content. In particular, radiolysis gases are released, so that pores are produced during polymerization. Moreover, in the case of acid incinerator ash, such as e.g. those resulting from the incineration of polyvinyl chloride, there is an inhibition of polymerization due to the fact that the resin hardener may be "consumed" by the ash. Thus, in the case of epoxy resin, the hardener is basic and is attacked by the ash which is acid, which prevents the hardening of the resin.

SUMMARY OF THE INVENTION

The present invention overcomes these disadvantages by providing a block for containing radioactive waste, as well as a process for the preparation of this block, which is applicable to all types of waste and which makes it possible to obtain an effective and reliable confinement thereof.

In the block according to the invention, the waste materials are coated in a composite matrix constituted by hardened cement and epoxy resin.

According to the invention, the proportion of waste is between 35 and 45% by weight, the proportion of cement between 25 and 35% by weight and the proportion of resin between 20 and 40% by weight. The waste materials can be of all types and particularly those referred to hereinbefore, namely wet waste, pulverulent waste and technological waste.

The invention also relates to a process for producing such a block. According to the main feature of the process, the latter comprises the following stages:

(1) mixing the waste with at least one cement, (2) adding to the mixture obtained in stage (1), water in a quantity adequate for bringing about hydration of the cement or cements, (3) mixing the product obtained in stage (2) with epoxy resin, and (4) allowing the cement or cements and resin to harden.

There can be a supplementary stage (5) performed after stage (2) and before stage (3) and which consists of converting the product obtained in stage (2) into granule form. Optionally, there can be a supplementary stage (6) performed after stage (5) and before stage (3), which consists of drying the granules.

Optionally, before carrying out stage (4), there can be a supplementary stage consisting of subjecting the product obtained to a degassing treatment and/or to another stage consisting of vibrating the product.

BRIEF DESCRIPTION OF THE DRAWING

The invention will become more clear from reading the following description of non-limitative embodiments with reference to the attached drawing, which is a graph giving, as a function of time, the temperature in the centre of a storage drum in the case of waste coated according to the prior art methods and according to the present invention.

DESCRIPTION OF THE PREFERRED EMBODIMENTS

EXAMPLES 1

The waste materials treated in this example consisted of coprecipitation mud or sludge of low and medium activity liquid effluents. The nuclear industry produces large quantities of sludge of this type, which is constituted by a mixture of different salts, such as sodium nitrate, barium sulphate, double nickel and potassium ferrocyanide, cobalt sulphide, etc. This sludge firstly undergoes washing with water for eliminating the soluble salts, such as sodium nitrate. After washing, the sludge had the following composition by weight: barium sulphate $BaSO_4$: 50 to 60%, double nickel and potassium ferrocyanide $Fe(CN)_6K_mNi_n$: 5 to 10%, cobalt sulphide CoS: 5 to 10%, water $H_2O$: 20 to 40%.

After washing, said sludge had an activity $\alpha \leqq 1$ $Ci.m^{-3}$ and an activity BY of approximately 70 to 850 $Ci.m^{-3}$.

It is pointed out that the constituents of said sludge and their relative proportions correspond to a special cement composition called "anti-acid cement". Thus, it is merely necessary to add to said sludge sodium silicate, of the commercially available type, to obtain a product which spontaneously hardens or sets in air. Thus, by adding sodium silicate, a product is obtained which has the composition of a cement, not taking account of the presence of water. On adding water to a cement, the latter hardens in air. As water is already present in the sludge, the addition of sodium silicate means that a product is obtained which is merely a mixture of water and cement, i.e. a product which hardens only in air. This reaction is made possible by the presence of a hydrosoluble sulphide such as cobalt sulphide. Optionally, in order to improve the mechanical strength of the product obtained, it is possible to add one or more commercially available cement. In the example performed, apart from sodium silicate, was added a high-alumina cement and a Portland-type cement. The weight composition of the product obtained was as follows:

| | |
|---|---|
| $BaSO_4$ | 20% by weight |
| $Fe(CN)_6K_mNi_n$ | 2% by weight |
| CoS | 2% by weight |
| $H_2O$ | 17% by weight |
| $SiO_2$ | 20% by weight |
| Sodium silicate (d = 1.33) | 6% by weight |
| High-alumina cement | 22% by weight |
| Portland-type cement | 11% by weight |

After production, this product underwent granulation by pressing through a grid and the granules obtained were then immersed in a mixture constituted by an epoxy resin and its hardener. The mixture had 100 parts by weight of resin for 60 parts by weight of hardener. Immediately after the granules were obtained, they were immersed in the resin-hardener mixture. The quantities of the granules and the resin-hardener mixture are calculated in such a way that the apparent volume of the granules is substantially equal to the volume of the resin-hardener mixture. The duration of resin hardening is 48 hours and that of cement setting 28 days. Thus, 28 days are necessary for the block obtained to ber perfectly hardened, but it is possible to handle it as soon as the resin is polymerized, i.e. after 48 hours, because the polymerization of the resin constitutes an initial hardening.

Observation of the blocks revealed that they were in the form of a resin matrix within which were trapped cement granules. The coated product obtained had mechanical properties superior to those of a coated product obtained with a hydraulic binder, i.e. cement alone, whilst having a good resistance to leaching. Moreover, this process makes it possible to produce a double confinement barrier. Thus, the radioactive elements are firstly enclosed in the cement granules and the latter are then coated with the organic polymer. This permits a very effective confinement of the water-soluble elements, such as cesium and, to a lesser degree, strontium. The leaching rate of said elements is consequently significantly reduced.

Moreover, in the case of a concentration of emitters exceeding the nominal content, i.e. 1 $Ci.m^{-3}$, the probability of the cement granules cracking is reduced as a result of the high adhesiveness of the resin forming the second barrier. Moreover, the radiolytic degradation of the resin by the readioactive elements is reduced as a result of the fact that the $\alpha$ particles are largely absorbed in the granules.

In example 1, the granules were introduced into the resin-hardener mixture substantially immediately after they were obtained, i.e. in the still wet state. They may optionally be subject to a hot drying in order to harden them before pouring them into the resin-hardener mixture.

EXAMPLE 2

In this example several tests were performed in connection with the coating of incinerator ash obtained from the incineration of fuel waste contaminated with $\alpha$ or $\beta\gamma$ emitters. This ash essentially consists of a mixture of metal oxides (silica, iron oxide, alumina, etc.). The ash treated in this example had an $\alpha$ activity of approximately 50 Ci per tonne and their weight composition was as follows:

| | |
|---|---|
| $SiO_2$ | 32 to 40% |
| $Al_2O_3$ | 18 to 19% |
| $Fe_2O_3$ | 4% |
| $TiO_2$ | 1 to 3% |
| CaO | 19% |
| MgO | 3.7% |
| $Na_2O + K_2O$ | 5% |
| $SO_3$ | 1 to 2% |
| Cl | 2.4 to 5.1% |

After grinding the ash, the powder obtained is well mixed with cements, such as dry commercial cements and in particular Portland-type cements. The latter were mixed with a product containing cement and water in a weight proportion of 40 parts of ash for 30 parts of water-cement mixture. In the cement, the weight proportion of the water compared with the cement was between 0.30 and 0.36. This was followed by a mixing or stirring of the mixture of ash, cement and water and a mixture of epoxy resin and hardener was added thereto in a weight proportion of 30 parts of resin-hardener mixture for 40 parts of the mixture of ash, cement and water. The proportion of hardener with respect to resin was 0.6 in the resin-hardener mixture. The product was vigorously stirred or mixed during the addition of the organic polymer in a mixer equipped with a homogenizing turbine. The paste obtained can easily be handled and can be moulded or conditioned in drums for storage purposes. Optionally, vacuum stirring can take place in order to degas the end product and optionally the latter can undergo vibration so as to improve its homogeneity. The block finally obtained had a density of 1.75 and a compressive strength of 65 to 80 MPa.

These values are much higher than the compressive strength of a coated product for which the waste is coated in cement only (strength of approximately 30 MPa). In the product obtained, it was found that the cesium had a much higher resistance to leaching by water than that which would have been obtained by coating the waste in cement only.

Example 3

The same waste as in example 2 was firstly mixed with dry cement in a proportion of 40 parts of ash for approximately 20 parts of cement.

In parallel, a mixture was prepared containing water, epoxy resin and a hardener containing 7 to 10 parts by weight of water for 30 parts by weight of the resin-hardener mixture. In the latter, the weight proportion of the hardener is approximately 0.6. The two products are mixed and are vigorously stirred in order to obtain a paste similar to that obtained in example 2. As in example 2, stirring can take place in a mixer equipped with a homogenizing turbine and, if desired, stirring can take place under vacuum or a reduced pressure in order to carry out degassing and/or said product can undergo vibration. In both cases, the hardening of the final product is brought about in 48 hours.

Thus, the process according to the invention has particularly interesting advantages because it is applicable to all types of waste and a block is obtained which has good mechanical properties and a good resistance to leaching, whilst also ensuring an effective and durable confinement of the waste. Comparative water leaching resistance tests on testpieces contaminated with plutonium and other $\alpha$ emitters, which had a specific activity of approximately $2.10^4$ Curie/tonne revealed the following results.

In the case of coated products only containing cement, fractures were revealed after 27 days, so that in a relatively short time period the sample was completely destroyed. However, the same waste materials coated in a cement-resin composite according to the invention revealed that the testpiece was intact after a water immersion period of 18 months. The waste was prepared in the same way as in example 1, but was not converted into granule form before being mixed with the resin.

Compared with coating in the resin alone the following advantages are obtained. As stated hereinbefore, the coating of certain ash types is difficult in epoxy resins. Thus, certain acid ash types, such as those resulting from waste with a high PVC content, react during coating and produce gases, such as hydrogen or ammonia. The gas quantities collected reveal that this is a partial neutralization reaction on the amine constituting the hardener. This leads to a swelling and polymerization phenomenon, i.e. a decelerated or inhibited hardening. The use of the cement-resin composite according to the invention makes it possible to obviate these disadvantages. Thus, the alkalinity of the cement permits a vast neutralization of the acidity of the ash and eliminates the hardener consumption reaction.

Moreover, the polymerization of the epoxy resins has an exothermal peak. Thus, after a few hours, the temperature of the coated products has a peak at values close to 170° C., which is the main reason for the shrinkage and the formation of cracks in the coated product. This product is greatly slowed down in the cement-resin composite, as is shown by the attached drawing. The latter gives, as a function of time t in hours the temperature T in ° C. for different types of coated products. Curve 1 corresponds to a 200 liter drum in which the waste is coated in a polymer only, the waste being in the form of ash, whose proportion in the coated product is 40%. Curve 2 corresponds to the same product as curve 1, but for a 100 liter drum. Finally, curve 3 corresponds to a 100 liter drum, but in which the waste is coated by the inventive process of example 2. The waste is constituted by ash representing 40% by weight of the end block.

It can be seen that after a time between approximately 5 and 10 hurs, curves 1 and 2 have a peak at approximately 170° C., whereas curve 3 has a peak at only about 90° C. after 10 hours.

Finally, it is obvious that the invention is not limited to the embodiments described hereinbefore, but all variants thereof can be envisaged without passing beyond the scope of the invention. Thus, the Expert can choose as a function of the particular case the cement, on using a commercial cement, or the nature and quality of the substance to be added, in the case where the waste can be converted into cement. He could also vary the relative proportions of cement, resin and waste in the final block and, as a function of the type of resin used, add thereto an inert filler, a catalyst or hardening accelerators or retarders.

We claim:

1. Block for containing and storing acidic waste, in which the waste is coated in a composite matrix of hardened cement and epoxy resin, wherein the proportion of waste is between 35 and 45% by weight, the proportion of cement is between 25 and 35% by weight, and the proportion of resin is between 20 and 40% by weight; the block being produced by mixing the waste with the cement to form a mixture; adding to the mixture water in a quantity adequate for hydration of the cement; mixing the hydrated cement product obtained with epoxy resin; and allowing the cement and resin to harden, to produce the block.

2. Block according to claim 1, wherein the waste belongs to the group consisting of wet waste, pulverulent waste and technological waste.

3. Block according to claim 1, wherein the block is further produced by converting the hydrated cement product into granules prior to said step of mixing with epoxy resin.

4. Block according to claim 4, wherein the block is further produced by drying the granules prior to said step of mixing with epoxy resin.

5. Block according to claim 1, wherein the block is further produced by subjecting the hydrated cement product to a degassing treatment prior to said step of allowing the cement and resin to harden.

6. Block according to claim 1, wherein the block is further produced by subjecting the hydrated cement product to vibration prior to said step of allowing the cement and resin to harden.

7. Block according to claim 1, wherein the waste comprises radioactive incinerator ash.

8. Process for containing and storing acid incinerator ash waste comprising mixing the waste with cement; adding sufficient water to the mixture of waste and cement for hydration of the cement; mixing the hydrated cement product so obtained with epoxy resin; and allowing the product to harden; wherein the proportion of waste is between 35% and 45% by weight, the proportion of cement is between 25% and 35% by weight, and the proportion of epoxy resin is between 20% and 40% by weight.

* * * * *